United States Patent [19]

Kondo et al.

[11] Patent Number: 4,834,230

[45] Date of Patent: May 30, 1989

[54] APPARATUS FOR DISCRIMINATING PAPER MONEY AND STACKING THE SAME

[75] Inventors: Hiroatsu Kondo; Akihiko Iwasaki, both of Osaka, Japan

[73] Assignee: I.M. Electronics Co, Ltd., Osaka, Japan

[21] Appl. No.: 117,560

[22] Filed: Nov. 6, 1987

[51] Int. Cl.[4] ..... G07F 7/04

[52] U.S. Cl. ..... 194/206; 221/198; 209/534

[58] Field of Search ..... 194/206, 207; 221/198, 221/227; 209/534; 232/15, 16

[56] References Cited

U.S. PATENT DOCUMENTS

| | | | |
|---|---|---|---|
| 4,045,017 | 8/1977 | Lundblad | 271/181 |
| 4,113,140 | 9/1978 | Graef et al. | 221/227 X |
| 4,678,072 | 7/1987 | Kobayashi et al. | 194/206 |

*Primary Examiner*—F. J. Bartuska

*Attorney, Agent, or Firm*—Birch, Stewart, Kolasch & Birch

[57] ABSTRACT

Apparatus for discriminating paper money and stacking the same includes a main body of the apparatus and a stacker box attached thereto detachably by the use of a hooking part and a hanging part provided on the main body and the stacker box, respectively and being able to engage with each other. The main body of the apparatus includes: a passage provided with a transferring roller for transferring paper money, a sensor for discriminating the paper money, and further the passage has a stuffing part for guiding both side parts of the paper money to expose the reverse side of the paper money; and a sending part for sending the paper money through the stuffing part backward. The stacker box includes: a base box, disposed back of the main body of the apparatus, having an opening part surrounding the stuffing part, and receiving the paper money inserted through the opening part and the stuffing part by the sending part; a covering plate for shutting the opening part at the time of at least having been released the engagement of the hooking part and the hanging part; and a locking member for locking the covering plate in a shutted state.

8 Claims, 16 Drawing Sheets

APPARATUS FOR DISCRIMINATING PAPER MONEY AND STACKING THE SAME

BACKGROUND OF THE INVENTION

This invention relates to an apparatus for discriminating paper money which has the ability of discriminating the authenticity of the paper money or the denomination of the same, and of receiving said money as in a stacked state.

There are used in various sorts of vending machines some kind of paper money discriminating apparatus which discriminates the genuineness or denomination of paper money and further receives the paper money discriminated as genuine notes in a stacked state. In such apparatus, there are heretofore inconveniences because of the paper money-receiving part taking the form of a box and being attached undetachably to the main body of the apparatus with the result that it is necessary to remove the paper money by grasping the received ones directly by hand, when the paper money sometimes are liable to scatter. Under these circumstances, the inventors of this invention have proposed by United States patent application Ser. No. 817,587 pending 311 an apparatus for discriminating paper money with a stacking means which is able to solve the controversial point as mentioned above and enables the collecting operation to be rapid and efficient by forming the paper money-receiving stacker box in what is called a detachable cartridge type.

And yet, since such a stacker box as mentioned above has a relatively large opening part for inserting paper money into the interior, the received paper money are within a range of the taker's eye at the time of collecting and consequently can be easily taken out, which threatens to induce dishonest pilferage when collecting.

SUMMARY OF THE INVENTION

An object of this invention is to provide an apparatus for discriminating paper money with a stacking means which has the ability to solve the controversial point as mentioned above on the basis of having a covering plate to shut the opening part and a locking means to lock the covering plate in a shut state thereof.

DETAILED DESCRIPTION OF THE INVENTION

Figure 1:
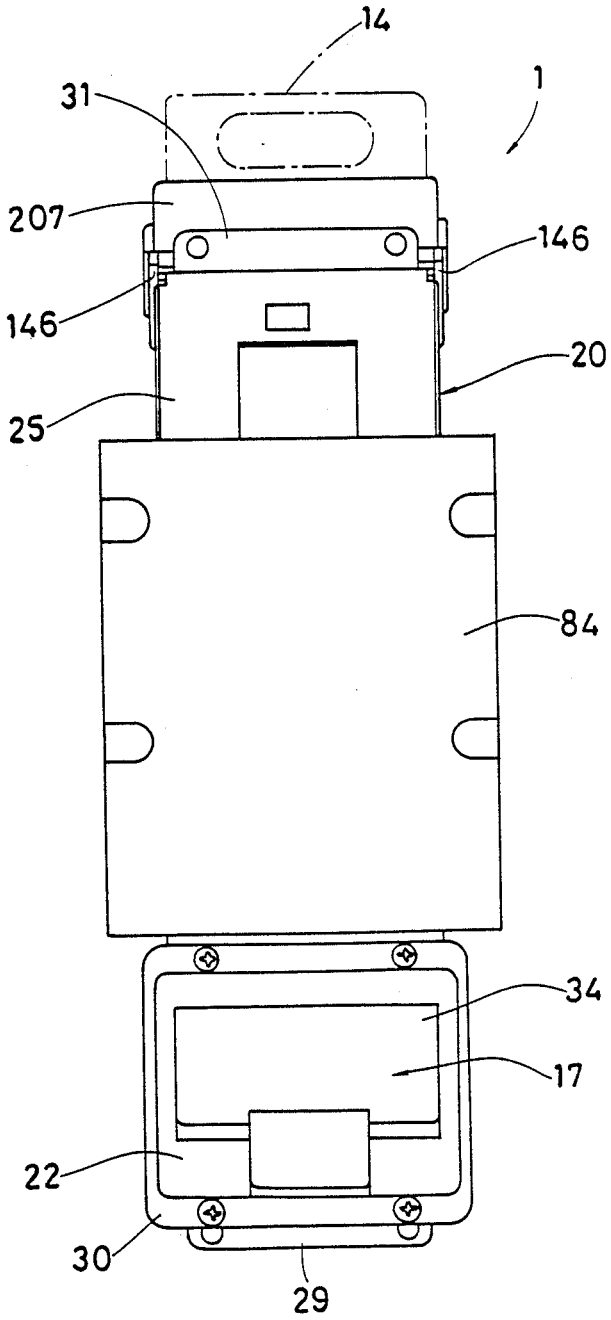
FIG. 1 is a front elevation showing an example of the invention.

Description will be now directed to an embodiment of this invention with reference to the accompanying drawings taking as an example the case where the apparatus for discriminating paper money with the stacking means according to a invention is formed in the capacity of a unit body which is to be incorporated into an apparatus such as, for example, a vending machine.

In the figure, the apparatus for discriminating paper money and stacking the same 1 comprises a main body 2 of the apparatus and a stacker box 3 attached thereto detachably by means of a hooking part 13 and a hanging part 12 provided on the main body 2 and the stacker box 3, respectively and being able to engage with each other. The main body 2 of the apparatus comprises: a passage 4 provided with transferring means 5 for transferring a paper money B in a developing state and with a sensor 6 for discriminating the paper money B, and further the passage 4 has a stuffing part 7 for guiding both side parts of the paper money B to expose the reverse side of the paper money B; and a sending means 9 for sending the paper money B through the stuffing part 7 backward. The stacker box 3 comprises: a base box, disposed back of the main body 2 of the apparatus, having an opening part 11 surrounding the stuffing part 7, and receiving the paper money B inserted through the opening part 11 and the stuffing part 7 by the sending means 9; a covering plate 14 for shutting the opening part 11 at the time of at least having released the engagement of the hooking part 13 and the hanging part 12; and a locking means 15 for locking the covering plate 14 in a shutted state.

Figure 2:
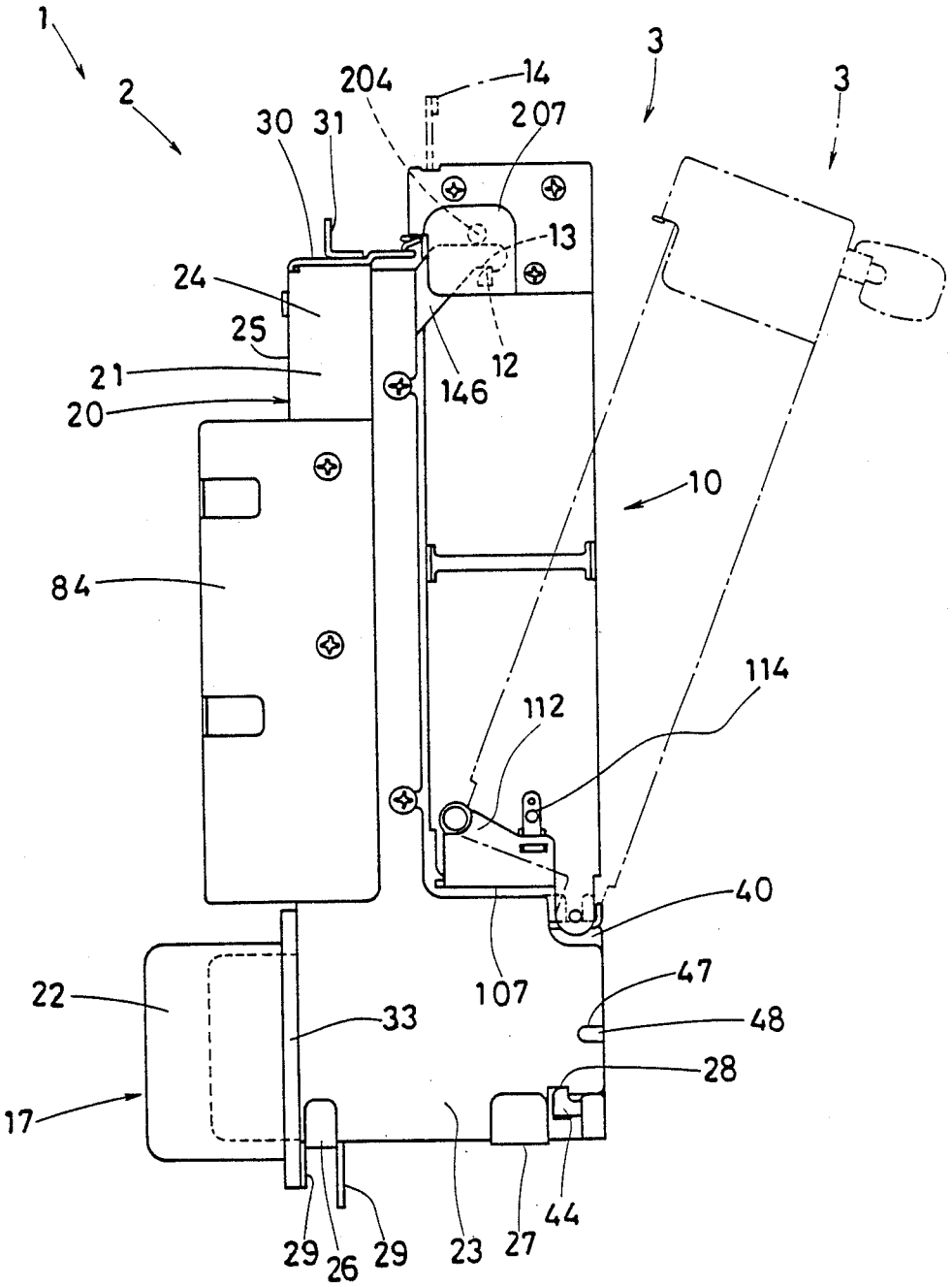
FIG. 2 is a side elevation thereof.
Figure 6:
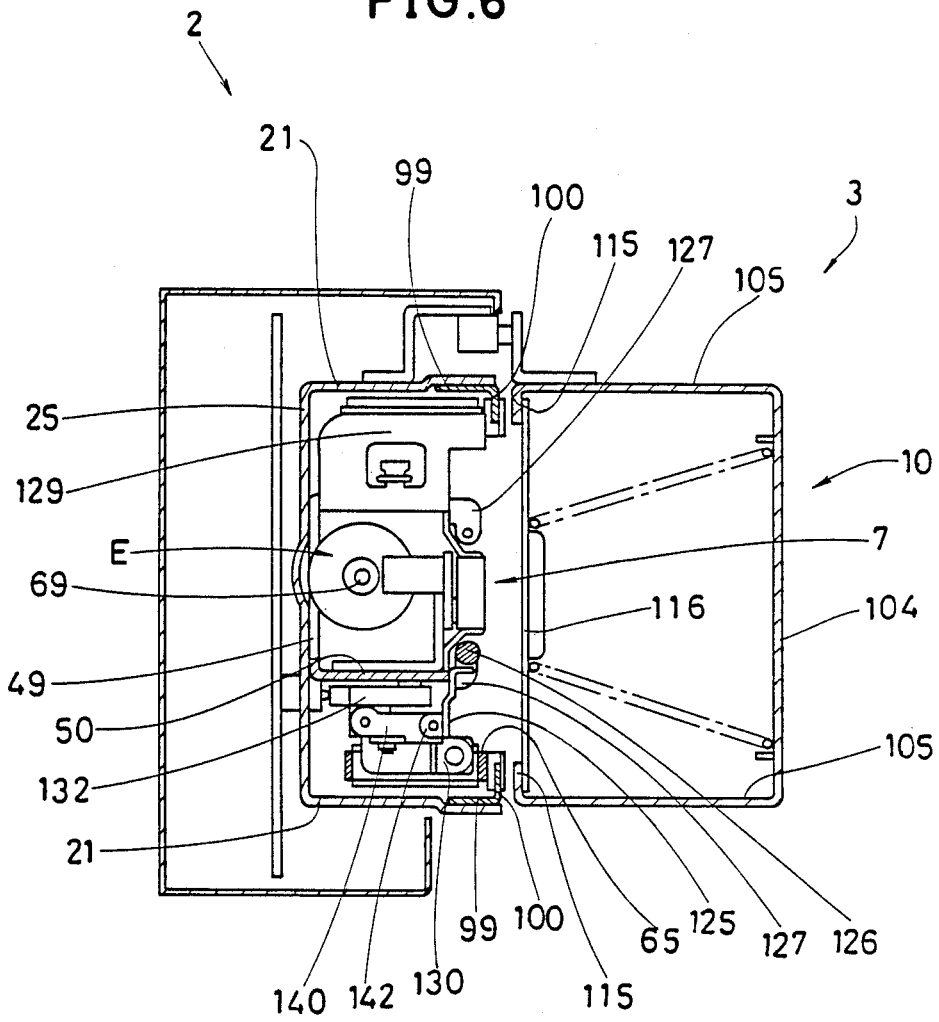
FIG. 6 is a transverse sectional view.

The main body 2 of a apparatus is possessed of the base frame 20. As shown in FIGS. 2 and 6, this base frame 20 raises erectly the upper plate part 24 narrow in width on the middle part of the lower plate part 23, and is possessed of plates 21, forming a reverse T-shape and a frontal plate 25 joining the front ends of the above-mentioned upper plate part 24. On the other hand, at the lower ends of the side plates 21, joining pieces 26 and 27 are spanned across. Beneath the joining piece 26 is fitted the fitting piece 29. Further, on the upper end of the frontal plate 25 is formed an upper plate 30 through bending. On this upper plate 30 is raised erectly a fitting piece 31. The frontal cover 22 being fitted to the lower end part of the base frame 20 constitutes a square cylinder shape surrounding the frontal end parts of the above-mentioned lower plate parts 23 and is fixed on the above-mentioned fitting piece 29 and on the front face of the frontal plate 25 by a flange 33 being formed on the rear end. The opening part on the front face of the frontal cover 22 forms an inserting port 17 through which the paper moneys B are to be inserted. This inserting part 17 is provided with an opening or shutting lid 34 which can be sprung up.

Figure 3:
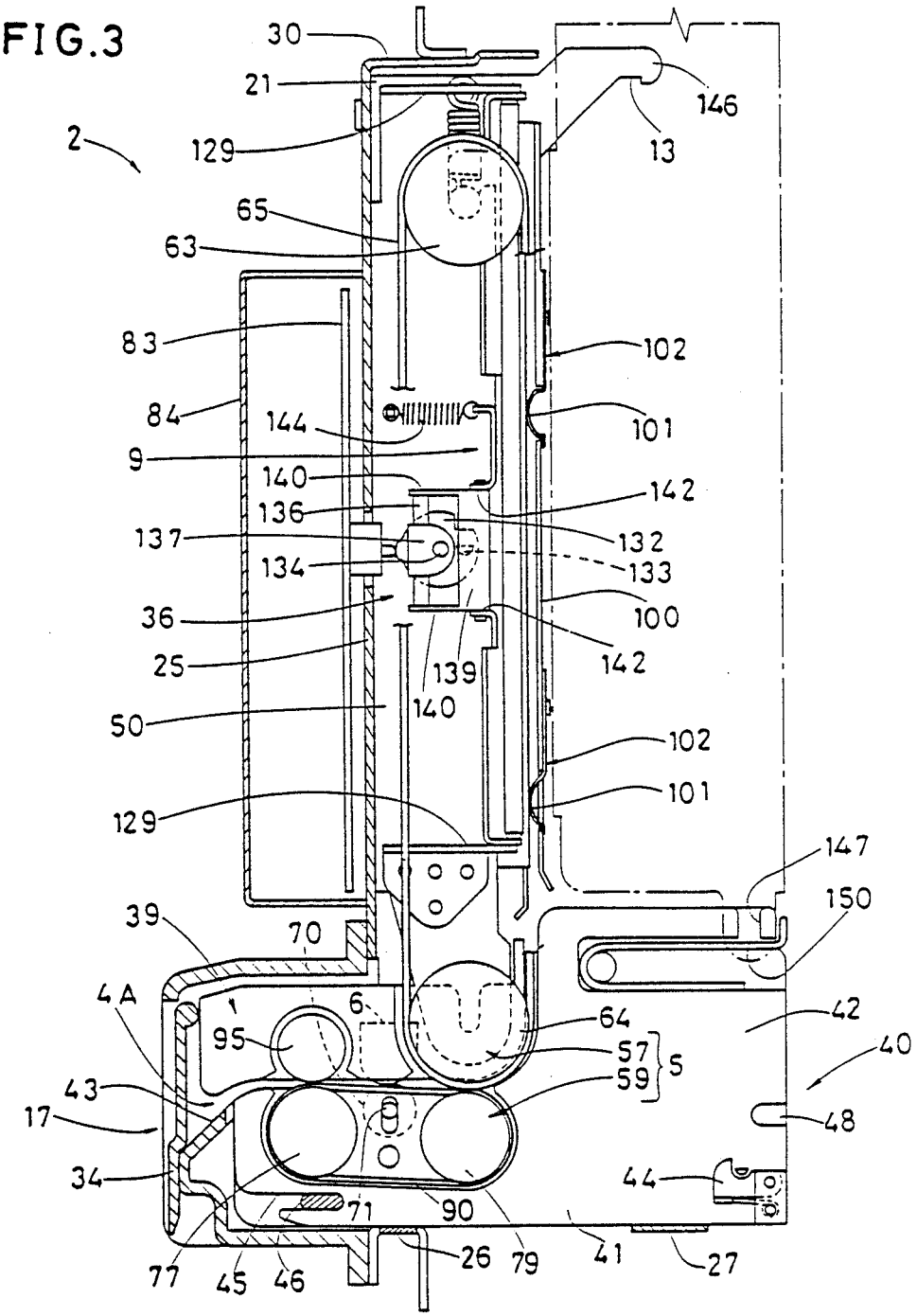
FIGS. 3 to 5 are longitudinal sectional views thereof.
Figure 4:
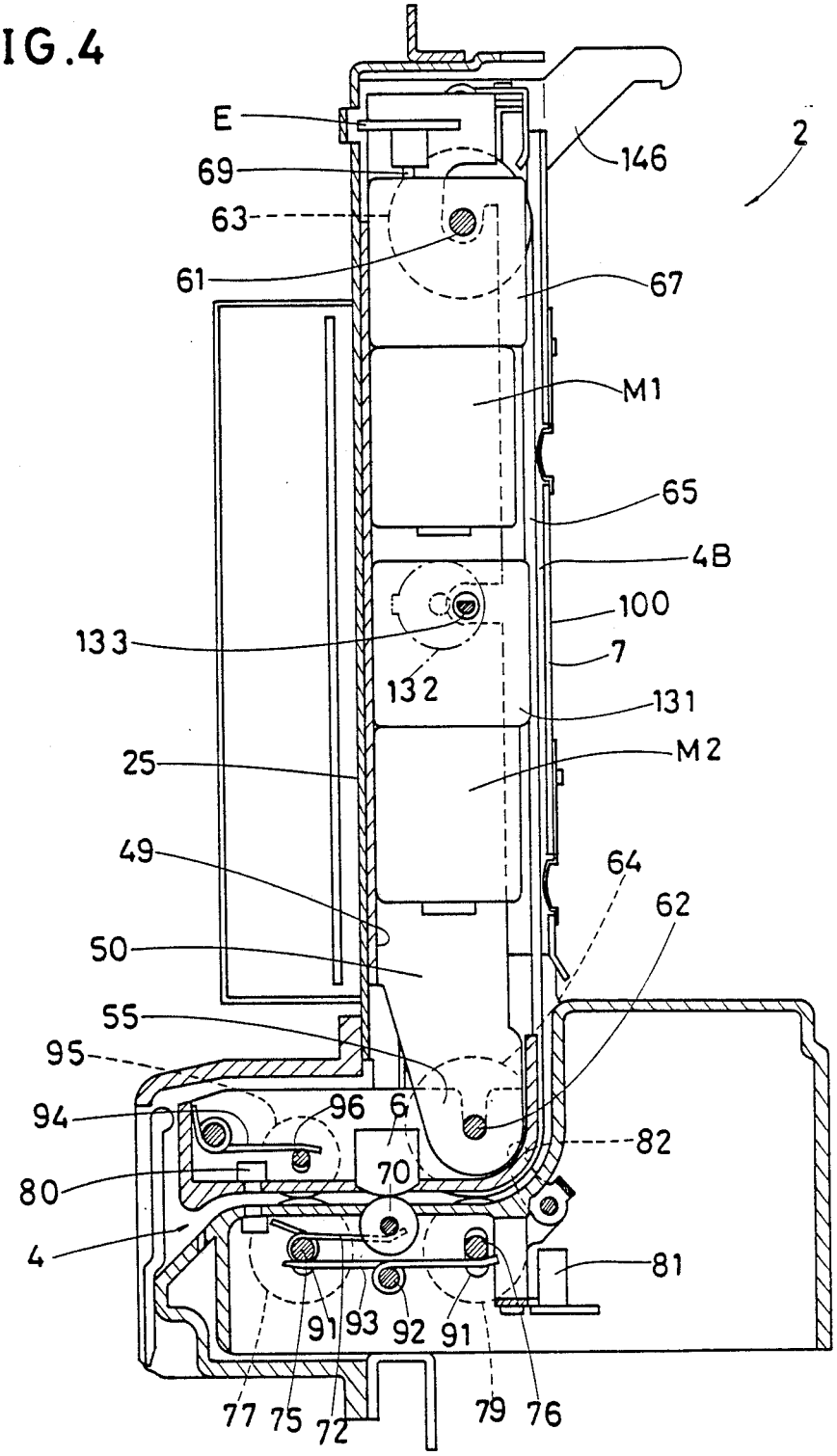
Figure 5:
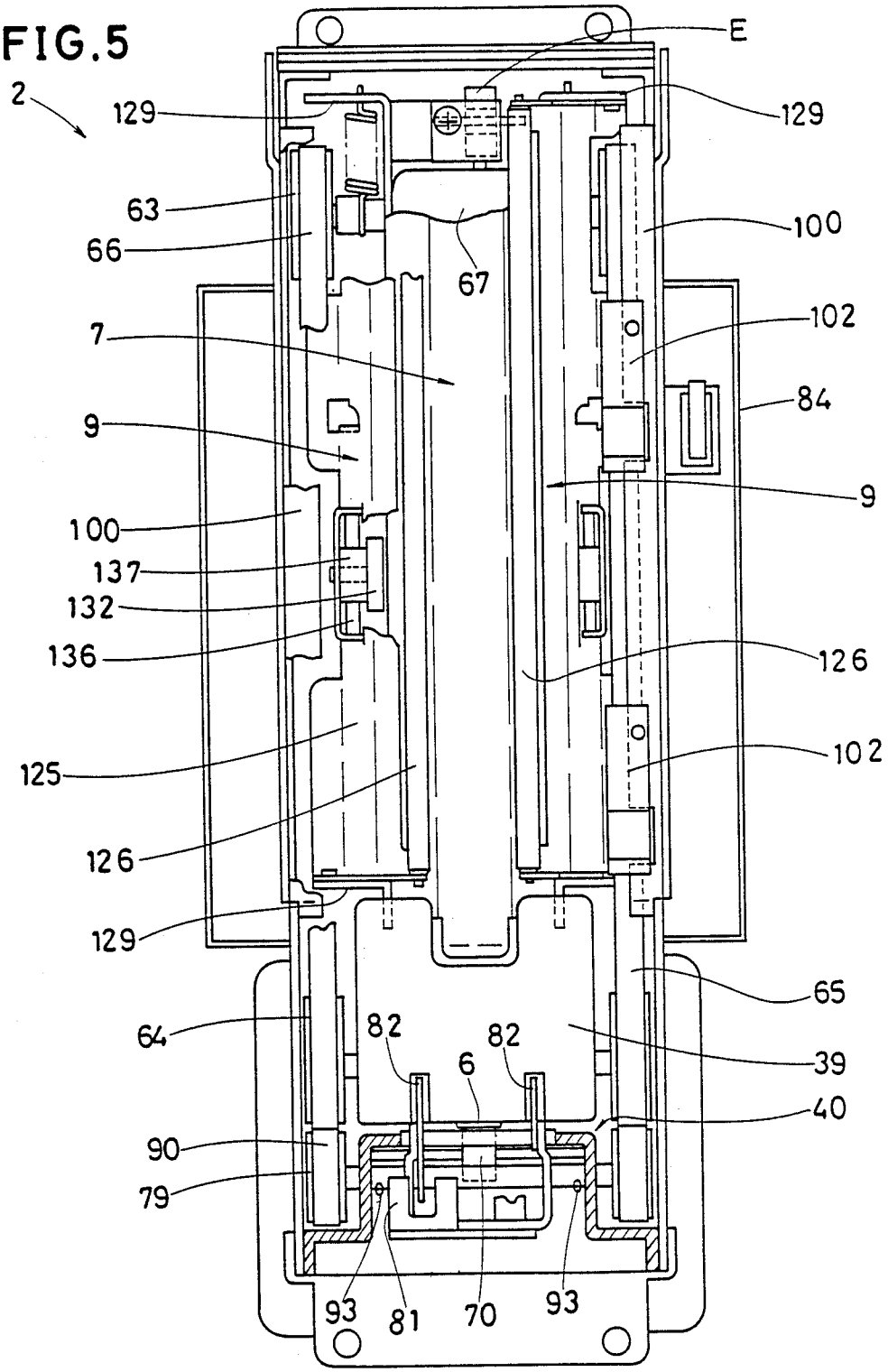

Further as shown in FIGS. 3 and 4, to the base frame 20 are fitted an upper block piece 39 and lower block piece 40 between the lower plate parts 23.

There is provided on lower block piece 40 at the rear fringe of the basal part 41 which is nearly the same in depth as the above-mentioned lower plate part 23 a projecting part 42, of which the form of a side face is L-shaped. The front end part of the above-mentioned basal part 41 is inserted into the frontal cover 22, and its front end impinges against the lower end part of the opening and shutting lid 34. The upper face of the basal part 41 forms at the rear end of its horizontal plane a smooth circular arced face continuing to the vertical front face of the projecting part 42, and also forms at its front end a guiding part 43 being composed of an inclined surface hanging down forward.

The upper block piece 39 is arranged spacing an almost fined interval above the basal part 41 of the above-mentioned lower block piece 40. This interval continues to the above-mentioned inserting part 17 and forms the lower passage 4A through which the paper monies B are transferred. Accordingly, this lower passage 4A is provided from before in order with the guiding part 43, the horizontal part, the circular arced part, and the vertical part, and guides the paper money B being inserted horizontally in an upward state as they are.

The upper and lower block pieces 39 and 40 are formed with a hollow-shape. The lower block piece 40 is fitted up extractably in the backward direction when the projecting piece 46 which is provided protuberantly on the inner face of the above-mentioned side plate 21 engages the groove 45 which is formed on the front fringe of the side face and further when the projecting piece 48 which is provided protuberantly on the above-mentioned side face engages the groove 47 which is formed on the rear fringe of the side plate 21. Besides, the lower block piece 40 is fixed on the base frame 20 when the hook 44 which is encouraged by a spring being fitted on the side face hooks the engaging part 28 where the rear fringe of the side plate 21 is notched in the form of a L-shape.

To the side plates 21 of the above-mentioned base frame 20 are attached guide fittings 99. The guide fitting 99 takes the form of an L-shaped cross section which forms orthogonally an inward-facing guide piece 100 on the rear end of the fitting piece to be fixed on the rear end part of the upper plate part 24 over the side plates 21. The guide piece 100 is provided both on the nearly middle part and the lower end part with the keep tool 12 which is possessed of the circular arced projecting part 101 being composed of leaf springs and protruding in the forward direction. Further, there is formed on a lower end of the guide piece 100 the guiding part being bent backward.

There is fitted in the interior of the base frame 20 an inner frame 19. This inner frame 19 takes the form of a U-shaped cross section by forming side plates 50 on both side fringes of the frontal plate 49 which is fixed on the above-mentioned frontal plate 25. On the other hand the lower end parts of the side plates 50, constitute inserting parts 55, to be inserted into the rear end part of the above-mentioned upper block piece 39.

The transferring tool 5 consists of a first transferring tool 57 which is disposed in a inner frame 19 and driven by the transferring motor M1, and the second transferring tool 59 which is arranged on the upper block piece 39 and the lower block piece 40 and which is driven by the first transferring tool 57.

First transferring tool 57 fixes fast the rotary bodies 63 and 64 on the both ends of the supporting shafts 61, 62 piercing through both the upper end part of the side plate 50 and the inserting part 55, and is wound round with endless link cords 65, being made up of timing belts between the rotary bodies 63 and 64. The supporting shaft 61 forms the gear unit 67 together with the worm wheel, the worm gear and the like, and makes a retardative revolution by the rotation of the transferring motor M1. Therefore, the running-backward line of the endless link cord 65 moves up and down owing to the normal or reverse rotation of the transferring motor M1. In this connection, a rotary encoder E is provided on the rotary shaft 69 which projects to the upper end of the gear unit 67 and which rotates synchronously with the supporting shaft 61.

The second transferring tool 59 fits up with the rotary bodies 77 and 79 on both ends of the supporting shafts 75, 76 piercing through the basal part 41 of the lower block piece 40, while the endless link cords 90 being made up of the timing belts are wound round between the rotary bodies 77, 79. The supporting shafts 75, 76 can move up and down through the long holes 91 . . . which are provided on the side plates of the lower block piece 40 and which extend in the upward and downward direction, and are encouraged by the spring 93 being disposed at both ends of the supporting pin 92 which is spanned between the above-mentioned side plates in the middles of the supporting shafts 75, 76. On the other hand, the receiving rollers 95, are provided aligning with the upper part of the rotary body 77.

The receiving rollers 95 are fixed fast on both ends of the supporting shaft 96 which penetrate through the long hole of the front end part of the upper block piece 39 and are encouraged downward by the spring 94. Accordingly, the running-upward line of the endless link cord 90 impinges upon both the under face of the receiving roller 95 and the under face of the endless link cord 65 of the first transferring tool 57. Through this impingement, the running-upward line of the endless link cord 90 is located in the center between the up-and-down movement through the above-mentioned under passage 4A, while the running-backward line of the endless link cord 65 is located in the center between the front and the rear of the vertical part of the passage 4A.

Further, the running-backward line of the endless link cord 65 and the guiding piece 100 face each other spacing a small gap in between; this small gap continues to the above-mentioned lower passage 4A, and constitutes the upper passage 4B forming the above-mentioned passage 4 together with the passage 4A. On the other hand, the projecting parts 101 of the keep tool 102 impinge against the above-mentioned running-backward line, while the guiding pieces 100 guide both side parts of the paper money B and also support vertically the paper money B together with the endless link cord 65 in between. In this connection, there is formed between and by the inner ends of the guiding pieces 100 the above-mentioned stuffing part 7 which makes the reverse face of the above-mentioned paper money B exposed.

In consequence, while supporting from inside and outside both side fringes of the paper money B being inserted into the inserting port 17 in a state of being developed, the transferring tool 5 can transfer them up to the stuffing part 7 in a state of being developed as they are.

There is disposed in the center of the above-mentioned passage 4 the sensor 6 for discriminating a paper money. In this example, a sensor 6 is the magnetic head having a pair of magnetoresistance elements and a magnet for bias, and is provided on the above-mentioned upper block piece 39 turning downward.

Further, there is additionally provided on a sensor 6 the pinch roller 70. This pinch roller 70 is attached to a supporting shaft 71 which is spanned movably up-and-down on the side plate of the lower block piece 40, is encouraged upward by a spring 72 being attached to the above-mentioned supporting shaft 75, and impinges softly upon the sensor 6. On the other hand, there is disposed on the front end of a passage 4A the detector 80 which is made up of a photosensor and which detects the insertion of the paper money B. Further, there are arranged at the circular arced part of the passage 4A lever pieces 82 which operate the detector 81 by impinging against the transferred paper money B so as to tilt, and which return to their original positions soon after the paper money B has passed through to prevent the returning back of the paper money B.

In addition, there are provided on the above-mentioned stuffing part 7 of the passage 4 the sending tools 9.

Figure 8:
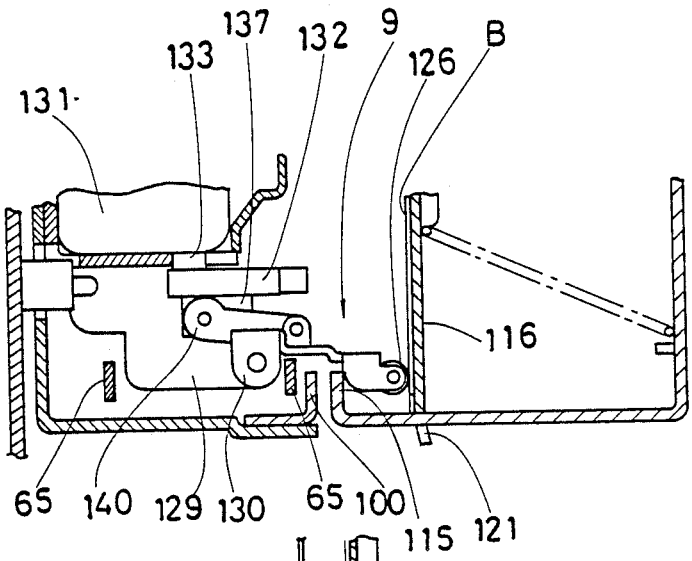
FIGS. 7 and 8 are cross sectional views showing the working of the sending tools.
Figure 7:
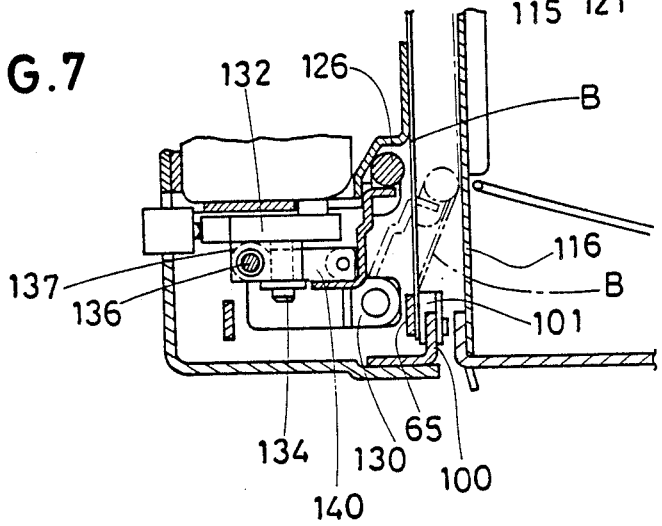

As shown in FIGS. 6 to 8, the sending tool 9 forms the bearing pieces 127 in the backward direction on the inner end of the basal part 125 being made up of bent piece of crankshaped cross section, and pivots the long roller 126 in between parallel to the passage 4B. Further, there are provided protuberantly turning backward on the outer end of the basal part 125 projecting pieces 130 being pinned on the bearing pieces 129 on the side plate 50 of the above-mentioned inner frame 19 above and below. Consequently, as shown in FIGS. 6 to 8, the sending tool 9 is able to swivel around the pivoting point which is located in the vicinity and in front of both side ends of the passage 4B. Through this swivelling, the roller 126 can swivel through the passage 4 from front to rear and through the stuffing part 7 up to the back of the above-mentioned guiding piece 100.

On the other hand, there is attached to the inner frame 19 a swivelling tool 36 to swivel the sending tool 9.

A swivelling tool 36 has sending motor M2 and the substantially the same gear unit 131 as the above-mentioned gear unit 67, and the disc-shaped cam pieces 132 are eccentrically fixed on both ends of the output shaft 133 projecting to both sides of the gear unit 131 and piercing through the side plates 50 while in the center of the cam piece 132 the pin 134 is protuberantly provided making eccentric the above-mentioned output shaft 133. There is pivoted on the pin 134 a sliding piece 137 floatingly pierced through the slide shaft 136 extending upward and downward. The upper and lower ends of the slide shaft 136 are connected through the arms 140 being connected by joining piece 139 to the supporting pieces 142 projecting to the frontal face of the above-mentioned basal part 125. There is spanned between the basal part 125 and the pin projecting from the front fringe part of the side plate 50 a spring 144. Consequently the sending tools 9 can swivel when the sliding piece 137 describes a circular motion by the rotation of the cam piece 132, and the slide shaft 136 pushes the basal part 125 backward through the arm piece 140.

On the above-mentioned main body 2 of the discriminating apparatus 1, there is formed the hooking part 13 for fitting up the stacker box 3. In this example, the hooking part 13 has an L-shaped notch provided on the lower fringes of the hooks 146 provided protuberantly turning backward on the upper end part of the side plates 21 of the base frame 20, and the rear fringe thereof is made circular arced. On the side face of the lower block piece 40 exposed by notching the upper corner part of the rear end of the lower plate part 23 of the side plate 21 in the form of a L-shape, there are provided hooking grooves 147 which extend upward and downward, but open at the upper end, and are arranged at the lower end with a receiving piece 150 being made up leaf springs.

The base box 10 of an stacker box 3 is fitted up with the upper plate 10 on the U-shaped frame having the rear plate 104 and the side plates 105, and also the lower plate 107 being capable of opening and shutting.

The rear plate 104 is made up of the rectangular flat plate body slightly larger than the paper money B, whose lower fringe is provided with the U-shaped notched part 109.

The side plate 105 is formed on the frontal fringes in such a manner that the narrow frontal pieces 115 may face each other turning inward, on the one hand, and on the other, there is provided on the lower fringe a projecting piece 111 being protuberantly provided with a hooking pin 110 in the inner face which is to be inserted in the above-mentioned hooking groove 147. There are provided in the inner face of the middle part of the side plate 105 continuous guiding grooves 122 extending in the forward and backward direction. By inserting into this guiding groove 122 the projecting piece 121 protuberantly provided on both side fringes of the receiving plate 116 which is made up of the rectangular flat plate body arranged parallel to the rear plate 104, the receiving plate 116 is supported movably at either end. What is more, this receiving plate 116 is encouraged forward by the spring 117 being arranged between itself and the rear plate 104, where both side fringes thereof impinge against the above-mentioned frontal pieces 115. Further, there is provided a notched part 109 also on the lower fringe of the receiving plate 116.

The lower plate 107 raises erectly on both side fringes of the side pieces 112 which are in line with each of the outer faces of the side plate 105. The upper front end part of the said side piece 112 is pinned on the above-mentioned side plate 105, and is brought to a stop being left open as it is when the projecting part turning outward of the lock piece 114 made up of a spring plate attached to the side plate 105 engages the hole part 113 provided in the inner face of the rear end part of the side piece 112.

Figure 11:
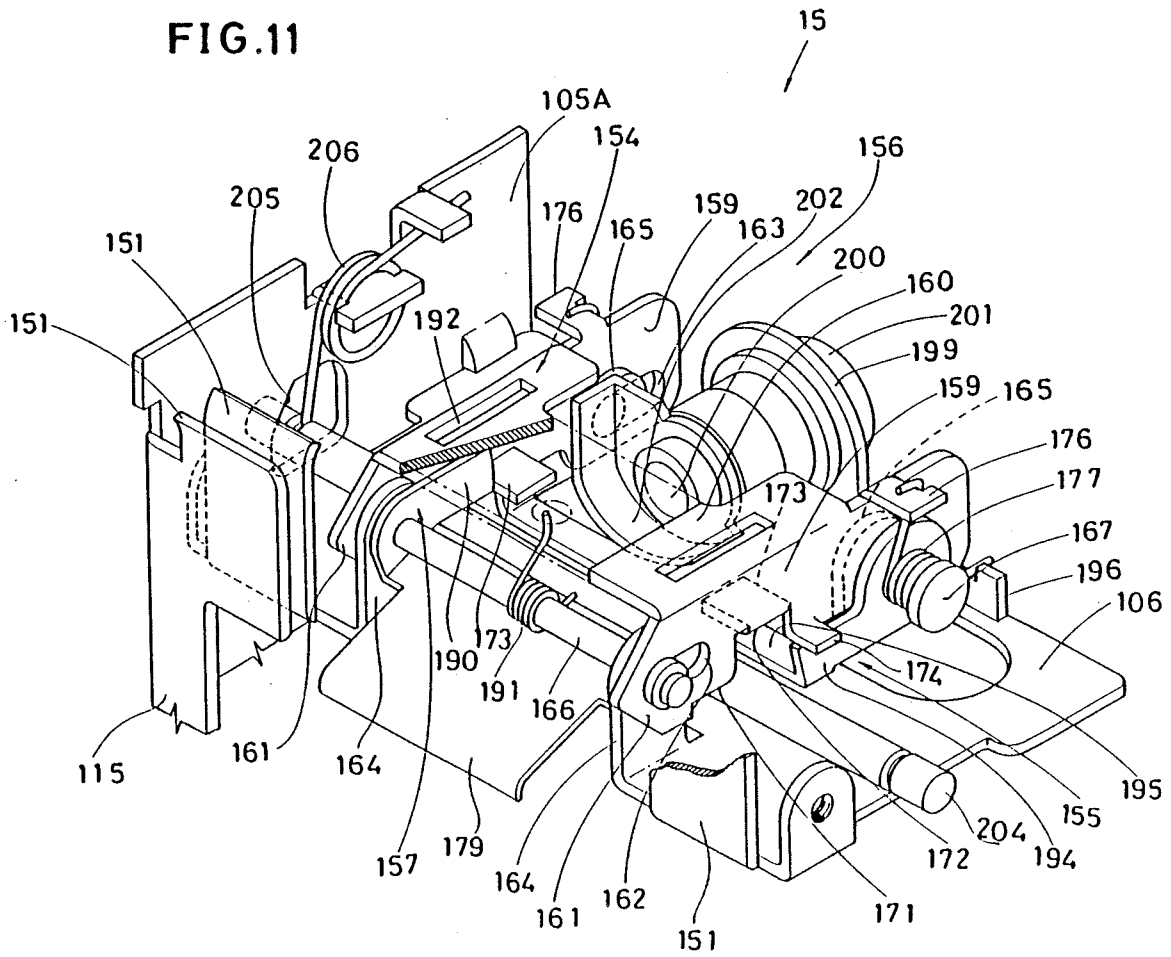
FIG. 11 is a perspective view thereof.

As shown in FIG. 11, the upper plate 106 is spanned over to the extension part 105A of the upper end of the side plate 105, which constitutes in this example the frame of the above-mentioned locking tool 15.

The base box 10 can be inserted in midway between the above-mentioned hooks 146 by inserting the hooking pin 110 into the hooking groove 147 to swing forward, when the base box 10 can be attached to the main body 2 of the apparatus through the engagement of the hanging part being made up of fan-shaped projecting parts which are formed on the side faces of the base box 10 with the hooking part 13 of the above-mentioned hook 146. In this connection, the base box 10 can be detached by being pushed down against the receiving piece 150 and swinging backward.

Being attendant on the attachment of the base box 10, the above-mentioned opening part 11 which is formed between the frontal piece 115 on the front of the base box 10 comes to surround the stuffing part 7 of the above-mentioned passage 4.

In consequence, as shown in FIG. 7 by the alternate long and two short dash line, the above-mentioned sending tools 9 send out the paper money B through the stuffing part 7 rearward, on the one hand, and on the other, the roller 126 pushes the paper money B against the receiving plate 116, and holds the paper money B with the receiving plate 116 between. Further as shown in FIG. 8, a sending tool 9 swings at the maximum angle in a state where the cam piece 132 rotates a half turn, while the roller 126 turns about to the rear of the frontal piece 115 while spreading both side parts of the paper money B. Consequently, the sending tool 9 in cooperation with the roller 126 tucks paper monies B through the above-mentioned opening part 11 into the stacker box 3. Further, when the cam piece 132 swings to make one revolution, then a sending tool 9 swings in the reverse direction. As the result, the receiving plate 116 shifts forward in accompaniment with the roller 126 and holds the paper money B between that receiving plate 9 and the frontal pieces 115. In this way, the paper monies B are received in tiers and within the stacker box 3.

Figure 9:
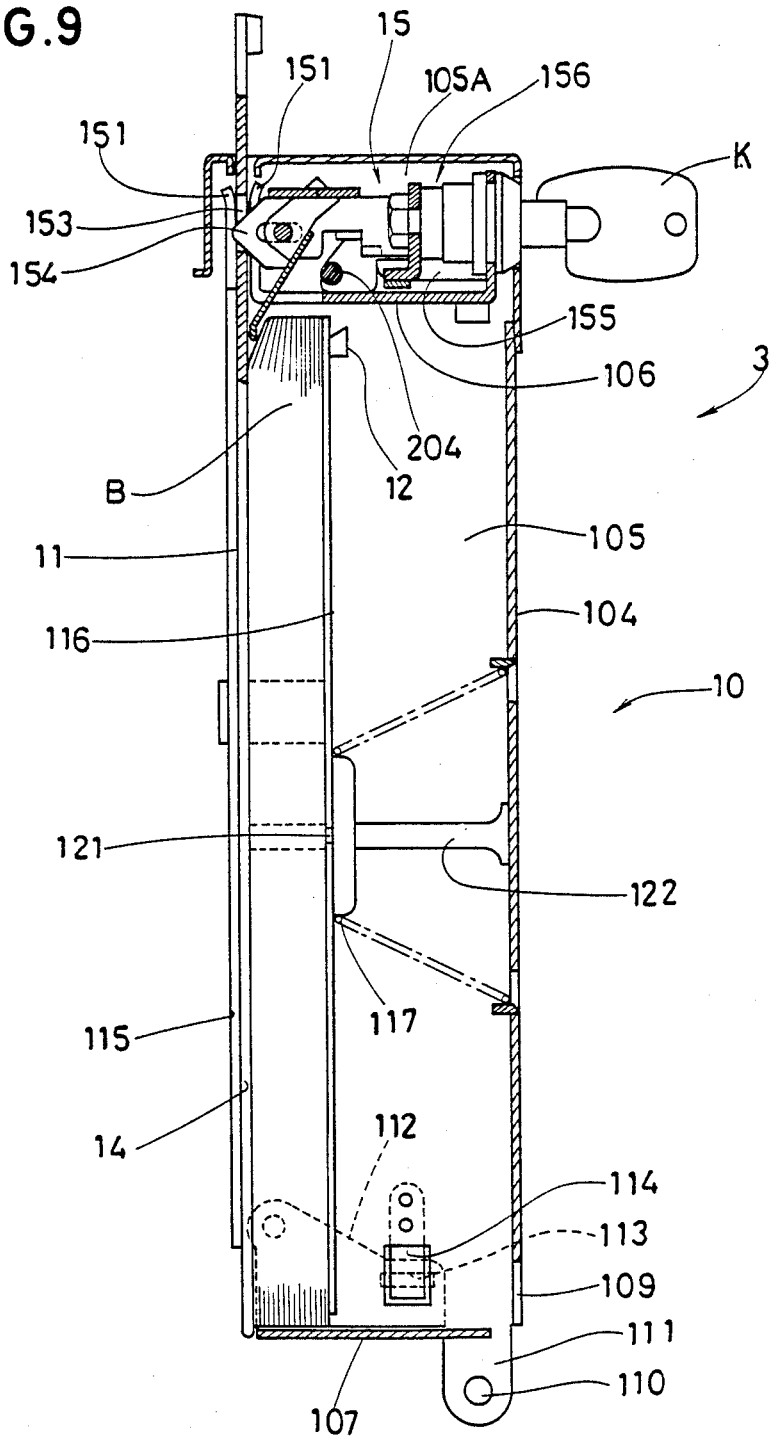
FIG. 9 is a cross sectional view showing the stacker box thereof.

The above-mentioned opening part 11 is closed by the covering plate 14. As shown in FIG. 9, this covering plate 14 is a rectangular flat plate body, which is to be inserted between the quiding pieces 151 being raised erectly from the upper end of the above-mentioned frontal piece 115 and the front fringe of the upper plate 106. When being inserted along the rear face of the frontal piece 115, the lower end of this covering plate is over the front fringe of the above-mentioned lower plate 107. Accordingly, the covering plate 14 shuts the opening part 11 and prevents the lower plate 107 to be left open on the basis of a state where the covering plate 14 impinges upon the front fringe of the lower plate 107.

Figure 10:
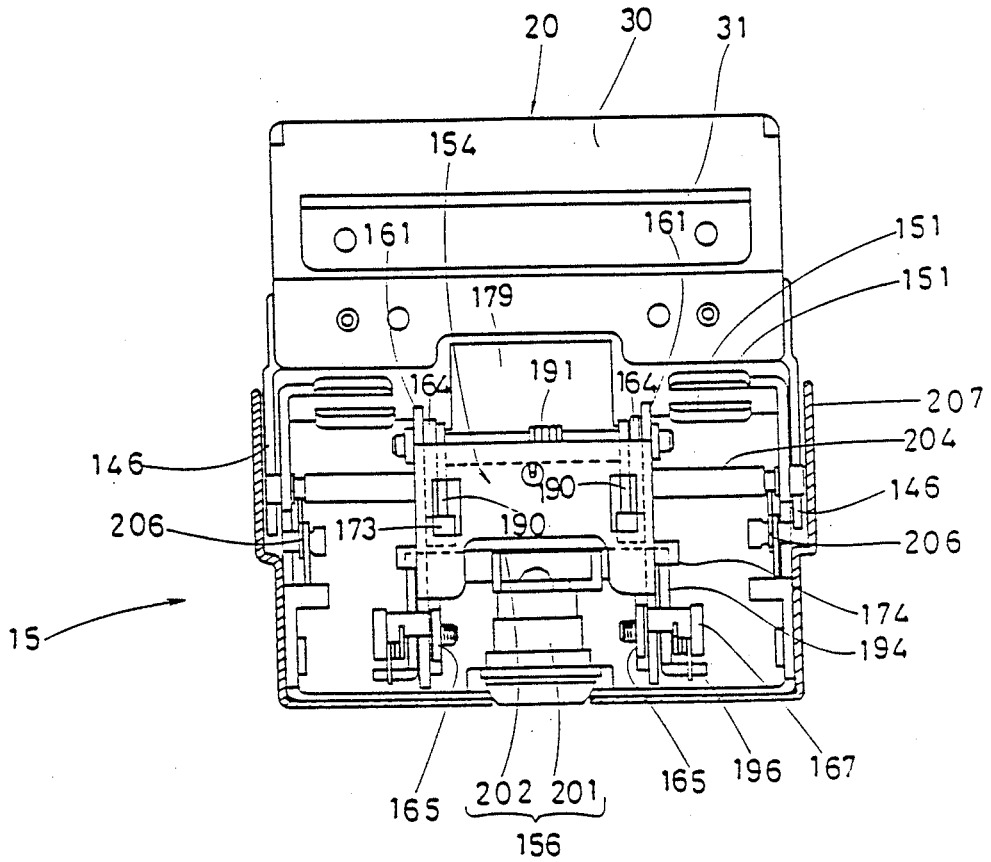
FIG. 10 is a top plan view showing the locking tool thereof.

As shown in FIGS. 9 to 11, the locking tool 15 is equipped with a sliding tool 154 the head of which engages through forward movement with the hooking holes 153 being fitted on the upper end part of the covering plate 14 and which thereby makes it impossible to draw out the covering plate 14 in the state of being closed; the stopper tool 155 makes it impossible for the sliding tool 154 being in a state of forward movement to move backward; and the releasing tool 156 which swings by the key K to release the stopper tool 155 from the hooked state.

As shown in FIG. 11, the sliding tool 154 is provided with the horizontal upper piece 160 and a side pieces 159 extending in the forward and backward direction, and takes the form of a turning-downward U-shaped cross section. The front end of the side piece 159 has a tapered face of an inclined angle of about 90°, and forms a fitting part 161 which fits into the above-mentioned hooking hole 153 of the covering plate 14. Further, there are provided on the front end part and the rear end part of the side plate 159 long holes 162, 163. On the other hand, there are raised erectly on the above-mentioned upper plate 106 at both sides in front and behind the standing pieces 164, and 165 along the inner face of the side pieces 159. The sliding tool 154 is able to slide forward and backward both by the slide shaft 166 passing through the above-mentioned long holes 162 and being spanned between the standing pieces 164 and by the slide pin 167 passing through the long hole 163 and fixing the inner end on the standing piece 165. Besides, there is provided on a under face of the side piece 159 the stair-shaped notch being provided with a hooking part 171 made up of a notched part of comparatively small height and an escape part 172 being made up of a notched part of comparatively large height and being set up jointly at the back of the former. Further, there is formed by bending on the upper fringe of the escape part 172 projecting pieces 173 which project inward, while the projecting piece 174 which projects outward is protuberantly provided at the back of the above-mentioned escape part 172 of the under fringes of the side piece 159. What is more, there is protuberantly provided on the rear end part of the upper fringe of the side piece 159 a turning-outward spring hanger bracket 176, on which one end of the spring 177 attached to the above-mentioned slide pin 167 is hooked and encourages the slide tool 154 forward.

In this example, the sliding tool 154 is hindered from forward movement by the stopper arm 157.

The stopper arm 157 is set up swingably between the standing pieces 164 through the above-mentioned slide shaft 166 to hook the front fringe of the above-mentioned projecting piece 173 using rear fringe thereof, and has a press part 179 and arm parts 190. The press part 179 projects forward beyond the inserted plane of the covering plate 14 to impinge against the covering plate 14 at the inserting time. The arm parts 190 rise erectly on both side fringes of the press part 179, and let the above-mentioned sliding shaft 166 pierce through the frontal end part thereof. Further, this stopper arm 157 is encouraged upward by the spring 191 being fitted on the sliding shaft 166. Further, there is provided on the above-mentioned upper piece 162 an escape hole 192 of the arm part 190.

The above-mentioned hooking state is released by the rear end of the arm part 190 being raised up at the inserting time of the covering plate 14.

The above-mentioned stopper tool 155 comprises arm parts 194 which are swingably fitted with a slide pin 167 on the standing piece 165 at the outer side of the above-mentioned side piece 159, and the joining piece 195 which is spanned between the front end of the under fringes of the arm parts 194 to interconnect them. On the other hand, there is protuberantly provided on a rear end of the arm part 194 the spring hanger bracket 196, on which the other end of the above-mentioned spring 177 is hooked. In consequence, the arm part 194 is encouraged upward at the front end by the spring 177, whereby the under face of the projecting piece 174 impinges upon the upper face of the head part of the arm part 194 at the going-back position of the sliding tool 154. On the other hand, the projecting piece 174 moves forward over the head of the arm part 194 in concert with the forward shifting of the sliding tool 154, so that arm part 194 raises up and thereby hooks the rear end of the projecting piece 174 at the front fringe of the arm part 194 to prevent the backward movement of the sliding tool 154.

The above-mentioned releasing tool 156 consists both of a main body 201 for locking which is clamped with screws on the fitting piece 199 being raised erectly on the rear fringe of the upper plate 105 and which is provided with rotary shaft 200 being put in rotation only by the corresponding key K, and of the key cam 202 which is fixed on the above rotary shaft 200 and which pushes down the joining piece 195 of the above-mentioned stopper tool 155 in accompaniment with the rotation of the above rotary shaft 200.

In this example, the locking tool 15 is provided with locking shaft 204 which makes it impossible to remove the stacker box 3 at the time of releasing the opening part 11 in cooperation with the above-mentioned sliding tool 154.

The locking shaft 204 is of a round bar form, and penetrates through the lower part of the hooking part 171 between the upper plate 106 and the sliding tool 154, the both end of which project from the hole parts 205 being provided on the above-mentioned extension parts 105A of the side plates 105 of the base box 10 and that to both sides of the base box 10 at the upper part of the above-mentioned hooking part 12. In this connection, the locking shaft 204 is encouraged forward by spring 206 being fitted on the inner face of the above-mentioned extension part 105A. Further, there is provided on the upper part of the base box 10 the upper cover 207 covering the locking tool 15 inclusive of the above-mentioned projective parts of the both ends of the locking shaft 204.

Figure 12:
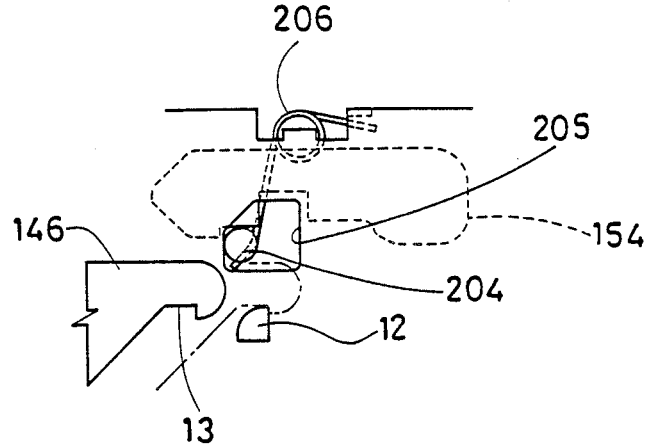
FIGS. 12 to 15 are diagrams showing the working thereof.
Figure 13:
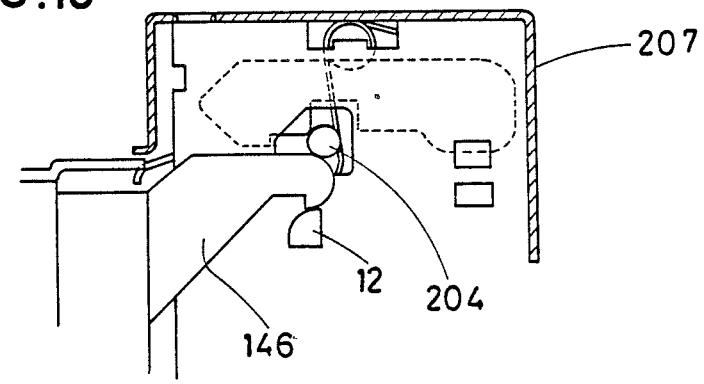
Figure 14:
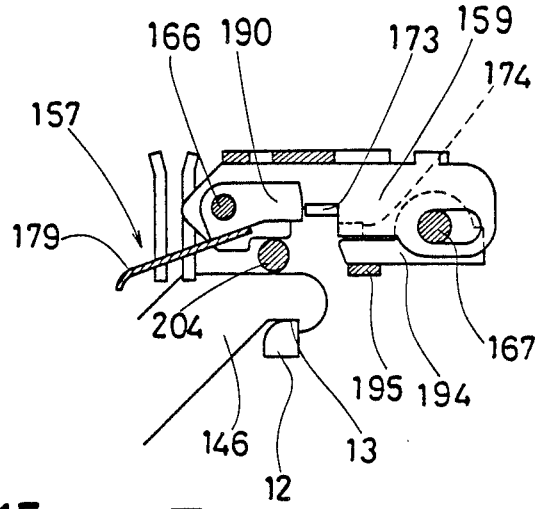

Consequently, at the time of setting up the stacker box 3 on the main body 2 of the apparatus, the base box 10 is inserted between the hooks 146 by inserting the hooking pins 110 into the hooking grooves 147 and thereby tilting the base box 10 forward, as mentioned above. At this time, as shown in FIG. 12, the above-mentioned locking shaft 204 is located at the front end part of the hole part 205 while being encouraged by the spring 206 and impinges upon the under face of the hooking part 171. And as shown in FIG. 13, the locking shaft 204 is pushed by the hook 146 and shifts to the rear end part of the hole part 205, when the hook 146 engages with the hanging part 12, as shown in FIG. 14, then the stacker box 3 is encouraged upward by the receiving piece 150 and goes up. In this state, the locking shaft 204 is inserted between the hook 146 and the hooking part 171 of the sliding tool 154 with the help of the spring 206.

In this way, the hook 146 is hooked between the hanging part 12 and the locking shaft 204, thereby making impossible the up-and-down movement of the stacker box 3 and the removal of the main body of the apparatus as well.

Figure 15:
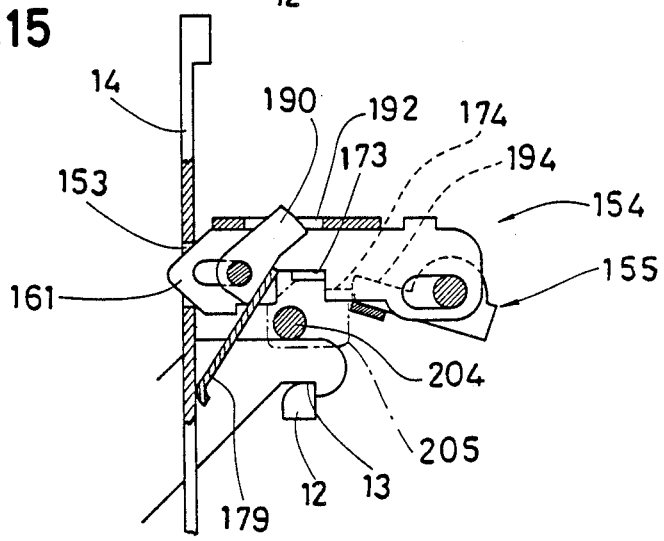

When required to remove the stacker box 3, the opening part 11 must be closed by the use of the covering plate 14. As shown in FIG. 15, by inserting the covering plate 14 between the guiding pieces 151 to close the opening part 11, the stopper arm 157 swings to allow the forward movement of the sliding tool 154, as mentioned above, whereby the fitting part 161 of the sliding tool 154 having moved forward fits in the hooking hole 123 to make impossible the removal of the covering plate 14. On the other hand, by the forward movement of the sliding tool 154, the escape part 172 goes ahead to the upper part of the locking shaft 204, whereby the locking shaft 204 becomes able to shift upward. In consequence, by pushing down the stacker box 3 against the above-mentioned receiving piece 150, the hook 146 can push up the locking shaft 204, thereby releasing the engagement of the hooking part 13 with the hanging part 12 and the stacker box 3 thus being able to be removed. As shown in FIG. 9, the press part 179 swings at the time of inserting the covering plate 14, presses down the upper end part of the paper money B . . . having been received within the stacker box 3, and makes easy the insertion of the covering plate 14.

Accordingly, since the stacker box 3 is closed at its opening part 11 by the covering plate 14 at the time of releasing the above-mentioned engagement, the paper monies B . . . having been received within the interior of the stacker box 3 are invisible to the person's sight and cannot to be taken out.

In order to take out from the detached stacker box 3 the paper monies B . . . having been received in the interior, the key cam 202 must be made to swing by rotating while inserting the key K into the key hole of the main body 201 for locking, and therewith to push down the joining piece 195 of the stopper tool 155. In a state of the sliding tool 154 being possible to go back, the bottom fringe of the hooking hole 153 shifts on the under tapered face of the fitting part 161 by forcedly pulling out the covering plate 14 to cause the sliding tool 154 to go back. Then it becomes possible easily to extract the covering plate 14. Such a state is shown in FIG. 9. By the covering plate 14 being pulled out, the stopper arm 157 is raised up through the spring 191, and the rear end of the arm part 190 hooks the projecting piece 173, as mentioned above, and thus the forward movement of the sliding tool 154 is prevented. With the release of the opening part 11 the lower plate 107 also becomes releasable, as the result of which it is possible to pull out the paper monies B . . . having been received out of the opening part of the bottom face of the base box 10 in a state of lying in a stack as they are.

The locking tool 15 in this example makes impossible the removal of the stacker box 3 from the main body 2 of the apparatus in the case of the state of the opening part 11 being released, on the one hand, and on the other, the very removal of the stacker box 3 from the main body 2 of the apparatus is enabled by shutting the opening part 11 by the covering plate 14.

Figure 16:
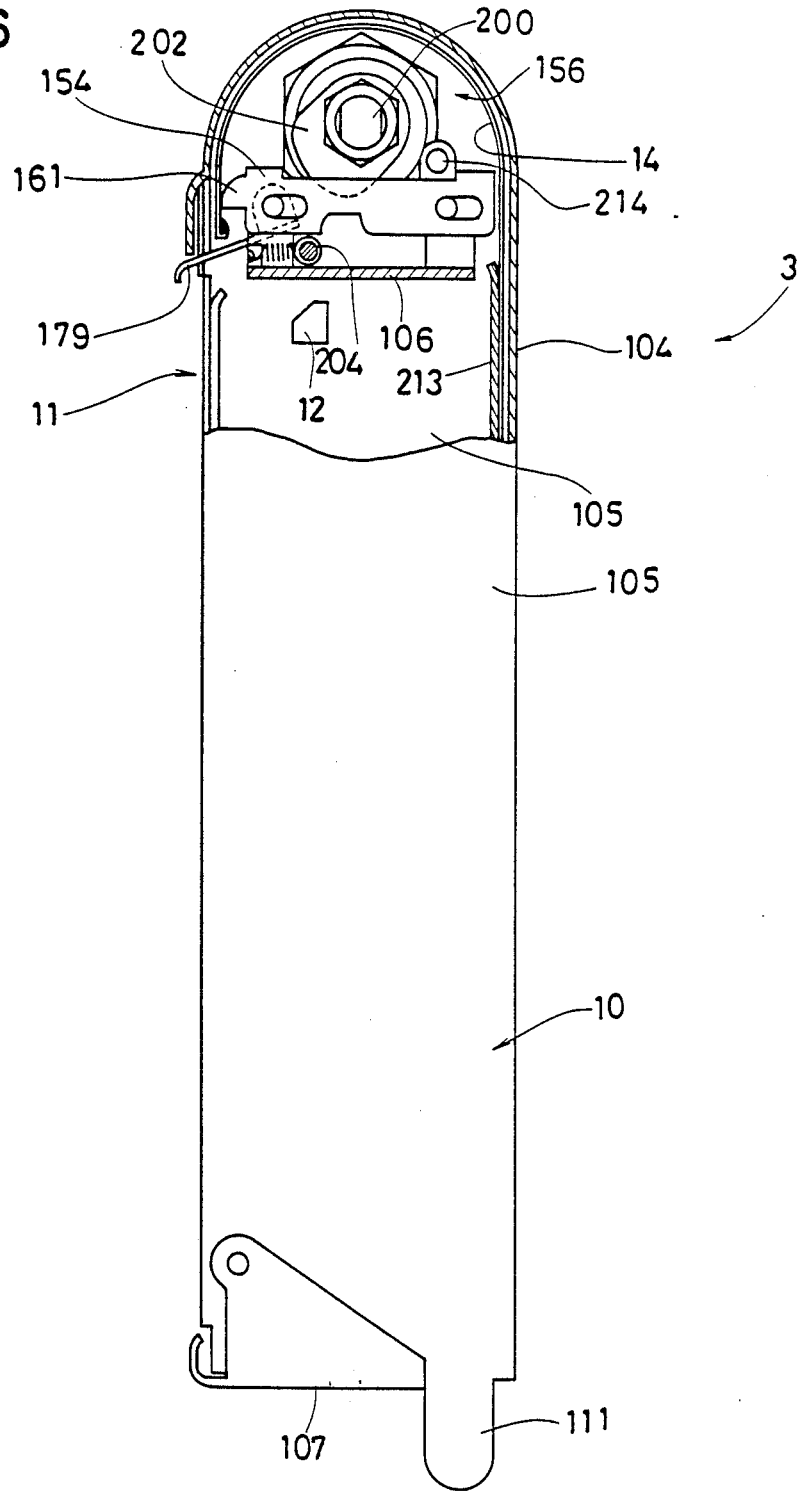
FIG. 16 is a cross sectional view showing another example of the stacker box.
Figure 17:
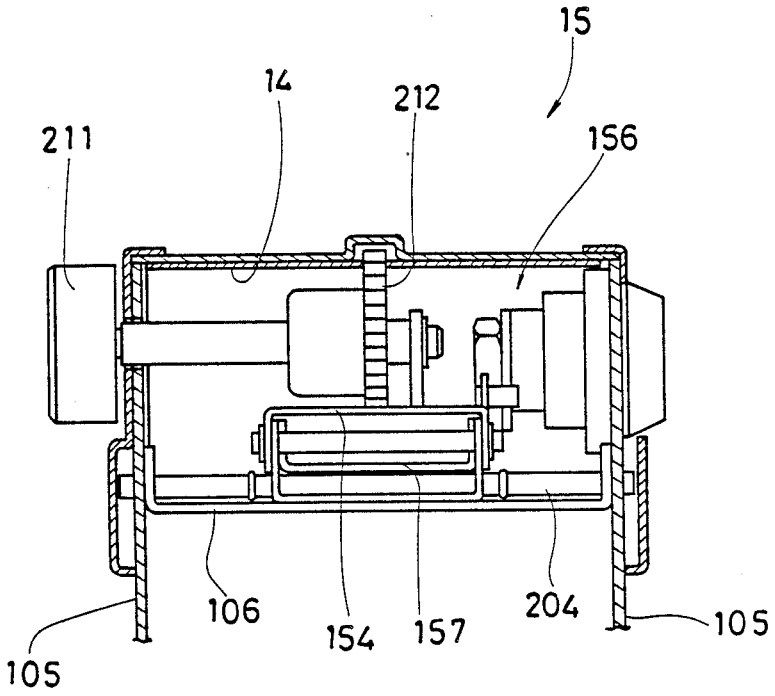
FIG. 17 is a cross sectional view showing the locking tool thereof.
Figure 18:
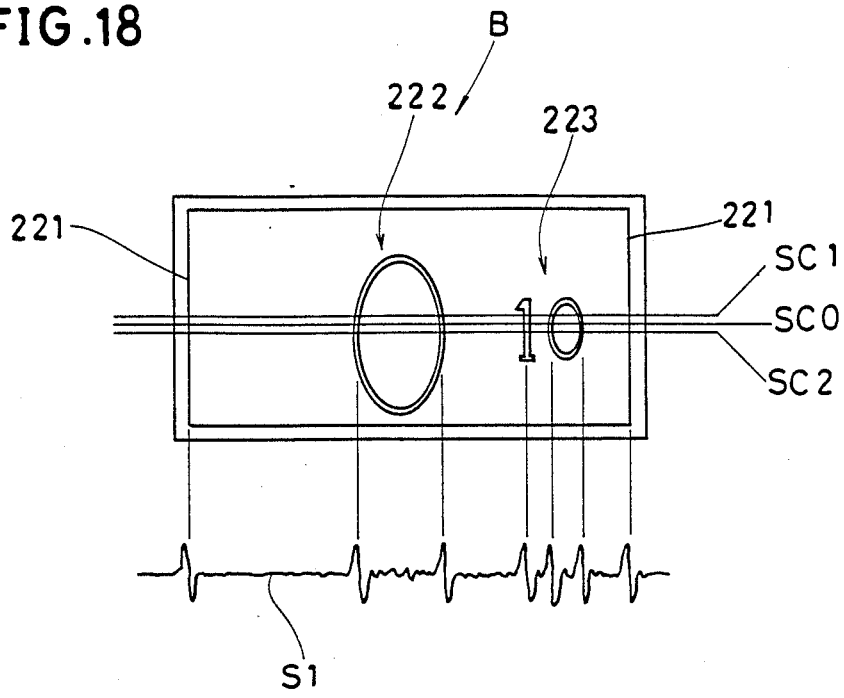
FIGS. 18 to 22 are type illustrations explaining the discriminating method of the paper money.
Figure 19:
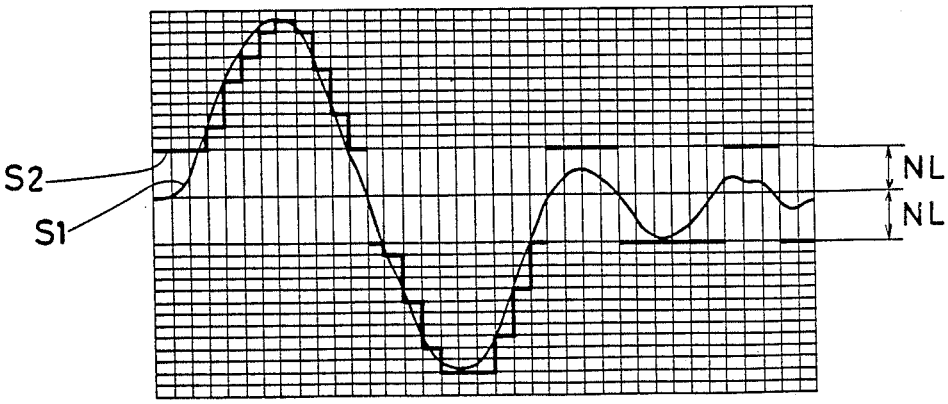

FIGS. 16 and 17 further show other examples of the stacker box 3 where the covering plate 14 is to be housed in the interior of the stacker box 3 at the time of the opening part 11 being released. The covering plate 14 is pulled out from between the back plate 104 and the parting strip 213 being disposed in front of the plate 104, by the sprocket 212 being turned round using the knob 211 provided on the side face of the side plate 105, which then shuts the opening part 11. What is more, in this shutting state, the sliding tool 154 goes ahead, the fitting part 161 fits into the hooking hole 153, and in this way the covering plate 14 is locked. To release this locked covering plate 14, the key cam 202 of the releasing tool 156 rotates, compresses the pushing piece 214 being raised erectly on the sliding tool 154 to make it go back, and then the knob 211 is forced to be turned.

In front of the main body of the apparatus, there is provided a printed base plate 83 of the control circuit being covered over by the cover 84.

This control circuit compares a pattern signal S2 which is acquired from the output of the sensor 6 scanning the pattern being printed on a paper money B using the magnetic ink along the scanning route SCO extending in the longitudinal direction of the paper money B, with the standard pattern signal R, on the basis of which the genuineness of the paper money and the denomination is discriminated.

The control circuit comprises a microprocessor, ROM, RAM, an interface, and others, and is what is called a micon which works under program stored previously in ROM. To the interface are connected the above-mentioned sensor 6 through the an A/D converter, and also the detectors 80, 81, the rotary encoder E, the transferring motor 1, the sending motor M2, the alarm, and others.

Description will be now directed to the behavior of the control circuit with the reference to FIG. 18 to 22.

By inserting the paper money B in the passage 4, the detector 80 detects the paper money B and the transferring motor M1 rotates, then that paper money B is fed into the interior of the passage 4 with the aide of the transferring tool 5, as mentioned above. The rotary encoder E outputs a timing signal for data sampling every 0.2 mm on the printed surface of the paper money B in this example. The above-mentioned sensor 6 has an electrical property much like a magnetic head having a very wide gap, and outputs an analog signal S1 containing relatively wide pulses P1–P7 corresponding to the bordering lines 221 of the paper money B, the portrait part 222, and the sum-indicating part 223.

This analog signal S1 is converted by the A/D converter into, for example a, word of 8 bits sampled by the microprocessor every timing signal, thus is once stored within RAM. And the microprocessor processes the above-mentioned words stored within RAM and substracts the noise level from the value expressed by each word in order to eliminate the influence which noise has upon the discrimination of the paper money, and replaces the subtracted data with the original data. This data string is regarded as the above-mentioned pattern signal S2 for discriminating the paper money. This pattern signal S2 is compared with the standard pattern signal R stored previously within ROM.

The standard pattern signal R is one that prescribes the tolerance, in this example, the minimum of the amplitude centering around the reference level LO of the pattern signal S2, and that contains the standard pattern signals, for example, R1–R18 of 18 (=3 scanning routes ×3 denominations ×2 scanning directions) in total in the case of being scanned the above-mentioned scanning route SCO in the center and the scanning routes SC1, SC2 slightly shifting from both sides of the former with every denomination of the paper money to be discriminated (1 dollar, 5 dollars, 10 dollars) from both sides. The standard pattern signals R1–R18 are each compared with the pattern signal S2 in coincidence and non-coincidence.

The comparison is done in such a manner that the amplitude in the corresponding position of the pattern signal S2 and each of the standard pattern signals Rn (n=1 to 18) are compared. When the amplitude of the pattern signal S2 within the tolerance, in this example, is larger, it is considered as coincidence, but when the amplitudes of the standard pattern signals Rn are out of the tolerance, they are considered as non-coincidence. When the number of times of this non-coincidence is less than the value Dn predetermined for the then standard pattern signals Rn, it is decided that the standard pattern signals Rn coincide with the pattern signal S2.

Figure 20:
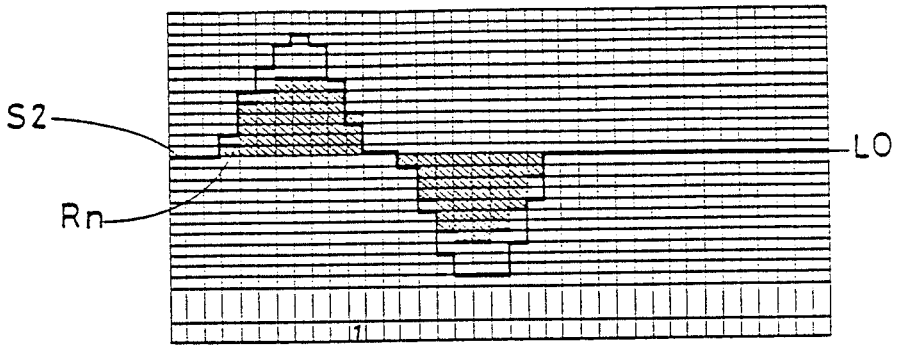
Figure 21:
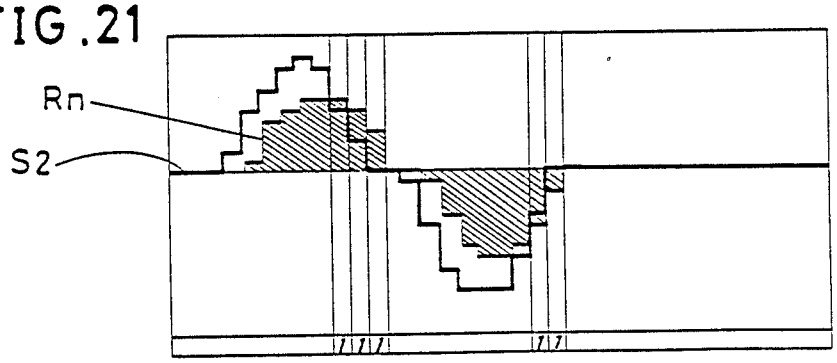
Figure 22:
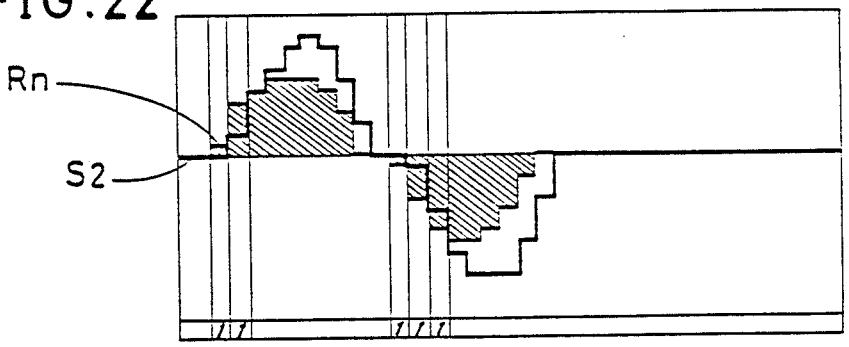

The comparison consists in comparing the amplitudes in the corresponding positions of the pattern signal S2 and the standard pattern signals Rn. This corresponding position is decided by shifting word by word, for example, up to the 8 words maximum, at both sides of the reference position centering around, for example, the reference state obtained while allowing the above-mentioned bordering line approximately to coincide. In this way, the same comparison as mentioned above is done at each shifting state. To illustrate the above typically, FIG. 20 shows the above-mentioned reference state, which is an example to be judged that in the pattern signal S2, only the 11th word from left in the figure is led to non-coincidence, but the pattern signal S2 and the standard pattern signals Rn coincide each with other. FIG. 21 shows the state of having shifted the standard pattern signals Rn by 1 word to the right against the pattern signal S2 where the number of times of non-coincidence becomes 5, which is judged that the pattern signal S2 does not coincide with the standard pattern signals Rn. Similarly, FIG. 22 shows the state where one word has been shifted to the left. This case also is judged as non-coincidence in the same manner as the above-mentioned.

Such a way of comparing by the pattern signal S2 is conducted on each of the standard pattern signals R1–R18. On the basis of the denomination of the coinciding standard pattern signals Rn, the genuineness of the paper money B and the discrimination of the denomination are carried out. In this connection, in the case of coincidences covering plural denominations or in the case where there are no coinciding denominations, it is judged that those are false paper monies or indiscriminable notes.

Therefore, the control circuit is able to make the discrimination regardless of the inserting direction of the paper money B being normal or reverse.

Further, it is able to compare the pattern signal S2 and the standard pattern signals Rn under the condition wherein the above-mentioned reference positions are made to coincide mutually and the conditions wherein those reference positions are made to laterally shift mutually spacing a small distance, in this example, by 0.2 mm on the paper money B, so that the discrimination is possible to be performed with high precision even when there occurs a discrepancy owing to the divergence in the sending direction of the paper money B or the tilt of the currency in the interior of the passage 4.

As has been hitherto described, the paper money B being inserted into the passage 4 screens the detector 80 and at the same time drives the transferring motor M1. Thereby, the paper money B is fed into the inner part of the passage 4 by means of the first transferring tool 57 and passes through under the sensor 6. On the other hand, as mentioned above, the sensor 6 reads the discriminating pattern printed on the paper money B and thereby discriminates the genuineness and the denomination. The paper money B being discriminated as a genuine note is guided by the first transferring tool 57 to the inner part of the passage 4B and stops there. On the other hand, the paper money B has both end parts being held between the first transferring tool 57 and the guiding piece 100, and its reverse surface is exposed by the stuffing part 7. The control circuit detects by the detector 81 that the rear end of the paper money B has passed through the lever piece 82, and stops the first transferring tool 57. With the stoppage of the first transferring tool 57, the swinging tool 36 goes into action, while the sending tool 5 stuffs the paper money B through both the stuffing part 7 and the opening part 11 into the stacker box 3, as mentioned above, and then the control circuit outputs what is called a vending signal to the apparatus such as a vending machine.

When the paper money B is impossible to be discriminated, then the transferring motor M1 is thrown into reverse, so that the paper money B is sent back toward the inserting port 17, simultaneously an alarm functions to give an alarm.

The sending tool 9 can send out smoothly the paper money by virtue of the rotatability of the roller 126, and further is able to push the paper money B against the receiving plate 116 while spreading out surely even when it is a used and worn-out paper monies B. Therefore, without allowing the paper monies to pile one upon other when being folded as they are, the paper monies B are received regularly in piles within the stacker box 3.

Incidentally, there can be utilized in the apparatus for discriminating paper money stacking the same 1 according to the invention such a sort as a photosensor other than the magnetic sensor in the capacity of the sensor 6.

Also the transferring tool 5 may be formed by a single transferring tool without using the first and second transferring tools 57, 59. Further the transferring tool 5 may be also formed by such as a couple of driving rollers and keep rollers without using endless link cords. On the other hand, the swinging tool 36 can be made using gears or cams of a certain-kinds even when those are able to swing the transferring tool 9. The apparatus for discriminating paper money and stacking the same according to the invention can be modified into various embodiments, for example, by forming so as to discharge undiscriminatable paper money to the other end of the passage 4.

As mentioned above, since the apparatus for discriminating paper money and stacking the same according to the invention is such a one that provides a locking tool which locks the covering plate to shut the opening part of the stacker box and that in a shutting state of the covering plate as it is at the time of removing the stacker box, the received paper money can be quickly collected together with the stacker box, thereby being able to promote the efficiency of the collecting operation of the paper money, the pilferages of the money can be prevented, the degree of safety is elevated, and such like. Many effects being brought about by this invention are immeasurable.

We claim:

1. An apparatus for discriminating paper money and stacking the same comprising:

a main body;

a passage in the main body including a stuffing part;

a sensor in the main body for discriminating paper money inserted in said passage to determine whether to accept said money;

transferring means, provided in said body, for transferring accepted paper money past said sensor into and outward of said stuffing part;

a stacker box removably mounted on said main body, said stacker box substantially sealed except for an opening surrounding said stuffing part when mounted, to receive said paper money transferred outward of said stuffing part into the stacker box;

engaging means including first means on said main body and second means on said stacker box engaging with said first means to mount said stacker box on said main body;

a shutter plate for shutting said opening, located in said stacker box along the inside of said opening, said shutter plate, when in a shut position in which said opening is shut, being located between the opening and the received paper money;

shutter locking means in said stacker box for locking said shutter plate in said shut position once inserted thereto, and stacker locking means for locking said stacker box on said main body, said stacker locking means being released after said shutter plate is placed in the shut position.

2. An apparatus according to claim 1, wherein:

said stacker box comprises a wall with said opening and includes a receiving plate biased by spring means toward said wall to hold the received paper money between said wall and said receiving plate, and a pressing plate disposed between an inlet for said shutter plate and a space for the received paper money, one end portion of said pressing plate being pivotally connected to the stacker box at a portion inward of the inlet for the shutter plate, the pivot thereof being substantially parallel to said wall and normal to the direction of the insertion of said shutter plate, the other end portion of the pressing plate is extended across said inlet, said shutter plate, when inserted, contacting and tilting said pressing plate, the tilted pressing plate pressing the received paper money away from said wall to provide a space for the shutter plate and guiding said shutter plate to said shut position between the opening and said received paper money.

3. An apparatus according to claim 1, wherein said shutter locking means includes:

a bolt member supported on said stacker box slidably in a direction across the inserting direction of said shutter plate; and spring means for biasing said bolt member toward the inlet for the inserted shutter plate;

the tip of said bolt member, when moved into a forward position, crossing the inlet for the inserted shutter plate, and said shutter plate having a hole adapted to receive said tip when in said shut position, whereby the shutter plate, when in said shut position, is locked by inserting the tip of the bolt member into the hole and is prevented from being removed from said shut position.

4. An apparatus according to claim 3, wherein said shutter locking means further includes:

preventing means for preventing a backward movement of said bolt member from said forward position, and a release key for deactivating said preventing means.

5. An apparatus according to claim 1, wherein:

said first means of said engaging means includes a hook and a groove;

said second means includes a catcher and a pin both fixed on said stacker box to engage with said hook and groove respectively;

said hook being extended in a direction toward said stacker box and having an L-shaped hooking portion at an edge on the groove side;

said groove being extended in a direction substantially normal to said hook extending direction;

the depthwise direction of said groove being substantially normal to said hook extending direction;

one end of said groove on the hook side being opened for inserting said pin therein, and the other end of the groove being provided with a spring for biasing the inserted pin toward said one end to press said catcher to said hooking portion, whereby the stacker box is mounted on the main body by inserting said pin into said groove, pressing the pin against said spring, and engaging said hooking portion with said catcher, said stacker box being removed by pressing the pin against the spring, and releasing the engagement between said hooking portion and catcher.

6. An apparatus according to claim 5, wherein:

said stacker locking means includes a locking member located on the opposite side of said hook with regard to said catcher and supported on said stacker box movably between a release position and a lock position, said locking member, when in said lock position, secures said hook between the locking member and said catcher, and said locking member, when in said release position, forms a space between the locking member and said catcher to break the engagement between said hooking portion and catcher, whereby said stacker box cannot be removed from said main body when said locking member is in the lock position, and can be removed in the release position.

7. An apparatus according to claim 6, wherein said stacker locking means includes a holding member for holding said locking member in said lock position, and a releasing member actuated by said inserted shutter plate to release the locking member from the held state, whereby said stacker box can be removed from said main body by inserting said shutter plate as a release key to said shut position.

8. An apparatus according to claim 7, wherein:

said stacker locking means includes a pressing plate jointed to said releasing member, said pressing plate being disposed between an inlet for said shutter plate and a space for the received paper money, one end portion of said pressing plate being pivotally connected to the stacker box at a portion inward of the inlet for the inserted shutter plate, the pivot thereof being substantially parallel to said wall and normal to the direction of the insertion of said shutter plate, the other end portion of the pressing plate being extended across said inlet, and said stacker box including a wall with said opening and a receiving plate biased by spring means toward said wall to hold the received paper money between said wall and said receiving plate, whereby the shutter plate, when inserted, contacts and moves said pressing plate, the moved pressing plate actuating said releasing member and pressing the received paper money away from said wall to provide a space for the shutter plate and guiding said shutter plate to said shut position between the opening and said received paper money.

* * * * *